313-414.
1-13-76 XR 3,932,786 SR

United States Patent [19]

Campbell

[11] 3,932,786

[45] Jan. 13, 1976

[54] ELECTRON GUN WITH A MULTI-ELEMENT ELECTRON LENS

[75] Inventor: Francis Joseph Campbell, Yardley, Pa.

[73] Assignee: RCA Corporation, New York, N.Y.

[22] Filed: Nov. 29, 1974

[21] Appl. No.: 528,400

[52] U.S. Cl. ..... 315/3; 313/414
[51] Int. Cl.[2] ..... H01T 29/29; H01J 29/82
[58] Field of Search ..... 315/3; 313/414, 412, 409, 313/411, 449

[56] References Cited

UNITED STATES PATENTS 2,143,390 1/1939 Schroter ..... 313/449 X 2,859,378 11/1958 Gundert et al..... 313/414 X

*Primary Examiner*—Robert Segal
*Attorney, Agent, or Firm*—Glenn H. Bruestle; Donald S. Cohen; George E. Haas

[57] ABSTRACT

The disclosed apparatus is a multiple beam electron gun having a wide focusing lens gap. The lens gap has a plurality of metal elements, spaced therein, each successive element of which has a successively greater voltage applied to it. The application of the voltages creates an electrostatic field which focuses a plurality of beams generated by the gun.

8 Claims, 3 Drawing Figures

ELECTRON GUN WITH A MULTI-ELEMENT ELECTRON LENS

BACKGROUND OF THE INVENTION

The present invention relates to an electron gun for producing and directing a plurality of electron beams, and more specifically to the means for focusing the beams on a target.

In a conventional color television picture tube having a multiple beam electron gun, each electron beam is passed through a separate electron lens which focuses each beam to a point on the target screen. The lens is essentially an electrostatic field which deflects the individual rays of the electron beam toward a common point as they pass through the lens. This field is normally established between two spaced electrodes positioned transverse to the beam paths. The electrodes have a series of apertures through which the electron beams pass. The characteristics of the lenses may be altered by changing the electrostatic field, which is usually accomplished by varying the voltage between the electrodes, the size of the apertures, the separation distance of the electrodes, or a combination of the above.

In some cases in order to reduce spherical aberration, it is desirable to have a long focal length electron lens. Since the voltage of the focus electrode must be restricted to values which do not cause arcing at the picture tube base, the focal length can most easily be lengthened by increasing the aperture size and/or the electrode spacing. However, if the spacing between the electrodes becomes too large (in excess of about 1.5 mm), the electrostatic focusing field becomes susceptible to interference from other electrostatic fields within the electron gun. Conversely, each focusing field created by the large spacing also interferes with the adjacent electrostatic focusing fields. Ideally therefore, the electron lens should have a relatively large diameter aperture, about 8 mm and a small electrode spacing about 1.5 mm.

The physical design of the electron gun also places several restraints on this configuration. In an in-line electron gun, as shown in U.S. Pat. No. 3,772,554 issued on Nov. 12, 1973 to Richard Hughes, there is a very close spatial relationship between the electron beams. Due to this close relationship, the lens characteristics may be adjusted only by varying the spacing of the electrodes since the aperture size is already maximized. Therefore, in order to duplicate the characteristics of the ideal large aperture lens in an in-line electron gun, the electrode spacing must be several times the maximum tolerable limit of 1.5 mm.

SUMMARY OF THE INVENTION

An electron gun has a control grid electrode, a screen electrode, and two accelerating and focusing electrodes spaced along the electron beam path from a cathode. Between the two accelerating and focusing electrodes is a wide gap. Within the gap are several electrode plates, each having an aperture therethrough aligned with the beam path.

Included within the electron gun is a resistor having two ends each attached to a different accelerating and focusing electrode. The resistor has a series of taps which are connected to the electrode plates.

DETAILED DESCRIPTION OF THE INVENTION

Figure 1:
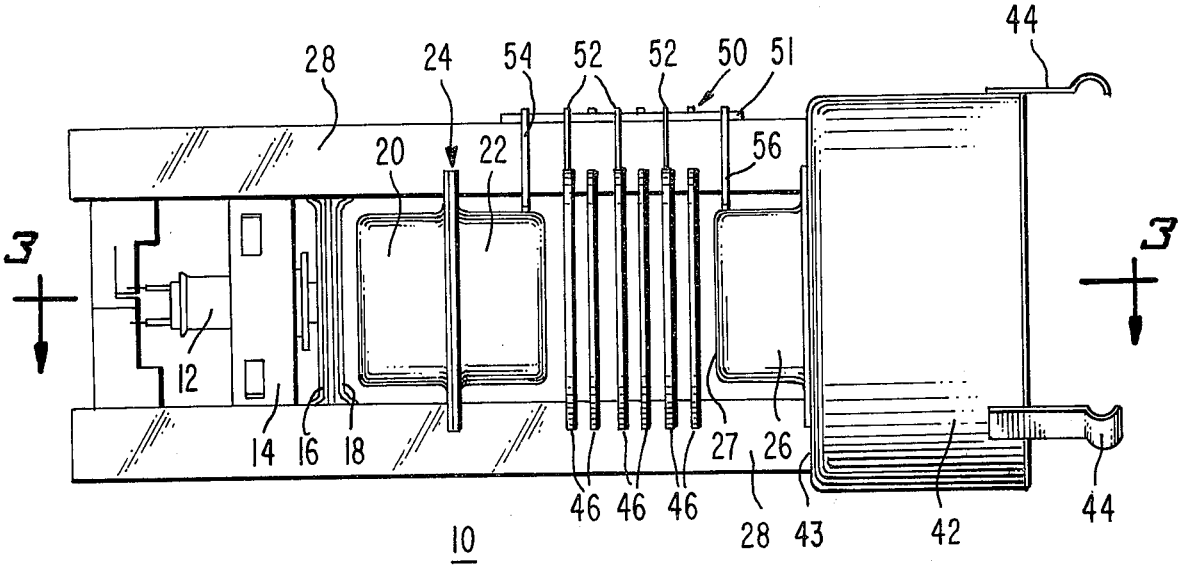
FIG. 1 is a side view of the improved electron gun.
Figure 2:
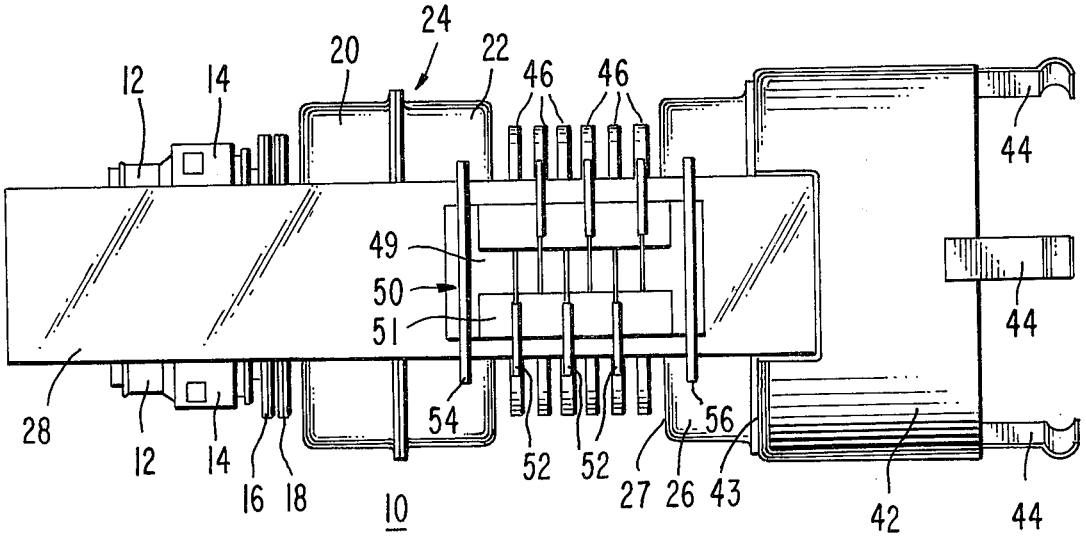
FIG. 2 is a top view of the improved electron gun.
Figure 3:
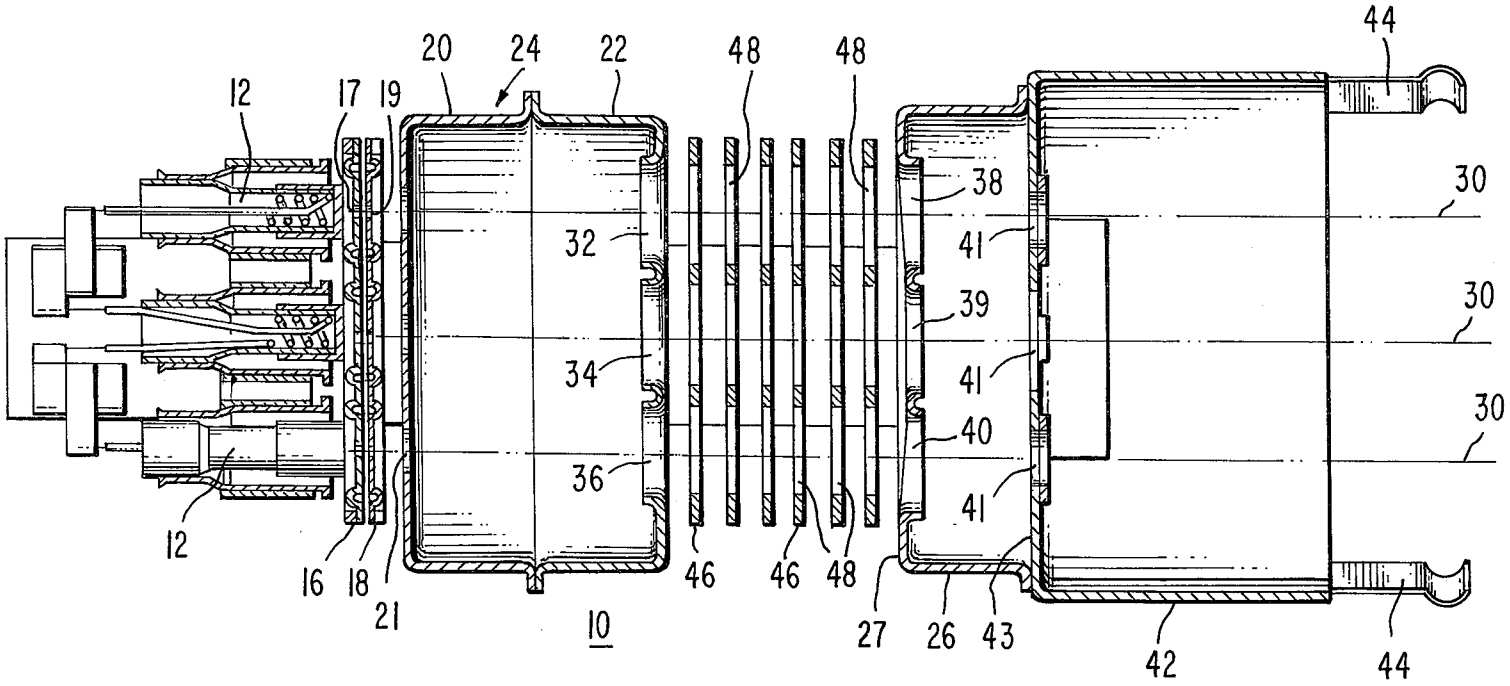
FIG. 3 is a sectional view taken on line 3—3 of FIG. 1.

The embodiment of the present invention, as shown in FIGS. 1 to 3, depicts an in-line electron gun; however, the present invention may be used on any geometrical gun configuration employing a wide-gap electron lens.

Refering to FIGS. 1 through 3, an electron gun 10 comprises two parallel glass support rods 28 between which various gun elements are mounted. At one end of the glass support rods 28 are mounted several support straps 14 on which three cathodes 12 are fastened. Following the support straps 14 are a control grid electrode 16, a screen grid electrode 18, a first accelerating and focusing electrode 24, and a second accelerating and focusing electrode 26 mounted in that order. The three cathodes project electron beams along three coplanar beam paths 30. The control grid electrode 16 and screen grid electrode 18 are closely spaced flat metal elements each containing three apertures 17 and 19 respectively, which are aligned with a different beam path 30, as shown in FIG. 3. The first accelerating and focusing electrode 24 is closely spaced from the screen grid electrode 18 and comprises two rectangular shaped cups 20 and 22 joined at their open ends. The closed ends of cups 20 and 22 each have three apertures such that each aperture is aligned with a different beam path 30. The apertures 21 in first cup 20 are larger than those in screen grid electrode 18 and the apertures 32, 34, and 36 in the second cup 22 are slightly larger than those in first cup 20.

Spaced from first electrode 24 is the second accelerating and focusing electrode 26 in the shape of a rectangular cup having a base 27. The base 27 faces toward the first electrode 24 and has three apertures 38, 39, and 40, preferably slightly larger than the apertures of the second cup 22. Middle aperture 39 is aligned with middle aperture 34 in the second cup 22. The two outer apertures 38 and 40 are slightly offset outwardly with respect to the corresponding aperture 32 or 36 respectively, in second cup 22. A shield cup 42 with a base 43 is attached to the second electrode 26 so that the base covers the open end of the second electrode. The shield cup 42 has three apertures 41 through its base 43, each aligned with one of the beam paths 30. The shield cup 42 also has three bulb spacers 44 attached to and extending from its open end.

Six metal plates 46 are mounted on the glass support rods 28 between the first electrode 24 and the second electrode 26 so that the spacing between each pair of plates does not exceed 1.5 mm. Each of said plates 46 includes three apertures 48 approximately equal in size to the apertures 32, 34, and 36 in the second cup 22. Each aperture 48 is aligned with a separate beam path 30. A resistor 50 is mounted on one of the glass support rods 28, adjacent to the position of the plates 46. Resistor 50 is a thin cermet film 49 deposited on a substrate 51 which is bonded to one of the glass support rods 28. In order to operate within the cathode ray tube, the resistor 50 must have a very small temperature coefficient of resistivity and must be able to withstand a high voltage (approximately 32,000 volts) that is applied to the second electrode 26. One end of the resistor 50 is electrically connected to the first electrode 24 by means of a first conductor 54. The other end of the resistor 50 is electrically connected by means of second conductor 56 to the second electrode 26. Each plate 46, successively spaced from the first electrode 24, is electrically connected, by means of electrical taps 52, to the resistor 50 at a point of successively greater resistance with respect to the one end of the resistor 50.

After the electron gun 10 is assembled inside a cathode ray tube (not shown), the bulb spacers 44 contact the inside surface of the tube establishing an electrical contact between that surface and the second electrode 26. When the electron gun 10 is operating, a first voltage, of about 4,000 volts, is applied to the first electrode 24 and a second voltage, in the range of 25,000 to 32,000 volts, is applied to the inside surface of the cathode ray tube. All of the voltages are with reference to the control grid electrode 16. The second voltage is also applied to the second electrode 26 by means of bulb spacers 44 and shield cup 42, creating a voltage difference between said first and second electrodes. This voltage difference is distributed to each plate 46 by means of resistor 50, the two conductors 54 and 56, and the taps 52 so that each plate 46, spaced successively further from the first electrode 24, is at a higher voltage than the previous plate. The distribution of the voltages is such that each plate 46 is maintained at approximately the same potential as the equipotential line at that point in an electrostatic field established in a large aperture electron lens.

There are two basic arrangements for establishing the electrostatic field between the first and second electrodes 24 and 26. The first arrangement forms a uniform electrostatic field in which the equipotential lines are equally spaced. In forming this field, the voltage applied to each plate 46 is proportional to the spacing of that plate from the two focusing electrodes 24 and 26. In this case, the taps 52 are spaced on resistor 50 proportionally to the plate spacing. The uniform field closely approximates the electrostatic field in the large aperture lens. However, in the large aperture lens the field is not exactly uniform. In fact, the equipotential lines near the beam path are closer to one another near the center of the lens gap than elsewhere between the first and second electrodes 24 and 26. A second arrangement more accurately duplicates this nonuniform field by applying the voltage disproportionately to the plate spacing. This can be accomplished by spacing either the plates 46 in the gap or the taps 52 on the resistor 50 evenly while spacing the other unevenly. In the second arrangement, the plates 46 are maintained at a voltage equivalent to the potential at their position in the electrostatic field of the large aperture lens.

The improved electron gun 10 has a focusing lens with the same properties as the large aperture electron focusing lens. The inclusion of the plates 46 stabilizes the field permitting a large focusing gap while minimizing external interference to within acceptable limits. This large focusing gap increases the focal length of the lens which reduces the aberration caused by the lens. By placing the resistor 50 within the cathode ray tube and electrically connecting the resistor to the first and second electrodes 24 and 26, the need for additional high voltage leads extending through the tube envelope is eliminated. This also eliminates possible lead insulation problems which could exist in small neck diameter cathode ray tubes where the leads would be closely spaced, to one another.

What is claimed is:

1. In an electron gun structure for producing and directing at least one electron beam along a beam path, said gun including a cathode, a control grid electrode, a screen grid electrode, a first accelerating and focusing electrode and a second accelerating and focusing electrode, spaced respectively along the beam path, the improvement comprising:

a plurality of spaced electrode plates positioned between said first focusing and accelerating electrode and said second focusing and accelerating electrode for expanding the focusing lens fields in the path of the beam, each plate having an aperture therethrough aligned with said beam path;

supporting means connecting said electrode plates; and resistive means attached at one end to said first accelerating and focusing electrode and at a second end to said second focusing and accelerating electrode and attached to said spaced electrode plates at spaced points between the ends of said resistive means, said resistive means being on said support means.

2. The device as in claim 1 wherein said device includes:

a plurality of cathodes for producing a plurality of electron beams; and each of said spaced electrode plates having a plurality of apertures therethrough, each aperture being aligned with a respective beam path.

3. The device as in claim 1 wherein said resistive means comprises a thin film cermet resistor.

4. The device as in claim 1 wherein the cathode, electrodes and electrode plates are mounted between a plurality of parallel support rods.

5. The device as in claim 4 wherein the resistive means is mounted on one of said support rods.

6. The device as in claim 5 wherein the resistive means comprises a thin film cermet resistor bonded to a substrate, said substrate being mounted on one of said support rods.

7. The device as in claim 1 wherein said spaced electrode plates are connected to the resistive means so that the resistance between said spaced electrode plates is proportional to their spacing.

8. The device as in claim 1 wherein said spaced electrode plates are connected to the resistive means so that the resistance between said spaced electrode plates is disproportional to their spacing.

* * * * *